US005108164A

United States Patent [19]

Gonzalez

[11] Patent Number: 5,108,164

[45] Date of Patent: Apr. 28, 1992

[54] BIN FOR INSTALLATION IN A CABINET HAVING A HINGED DOOR

[76] Inventor: Louis Gonzalez, 387 Roberts La., Scotch Plains, N.J. 07076

[21] Appl. No.: 644,083

[22] Filed: Jan. 22, 1991

[51] Int. Cl.[5] ..... A47B 46/00

[52] U.S. Cl. ..... 312/321.5

[58] Field of Search ..... 312/321.5, 329, 238, 312/271, 273, 274, 127, 129

[56] References Cited

U.S. PATENT DOCUMENTS

| | | | |
|---|---|---|---|
| 836,106 | 11/1906 | Feldkircher | 312/329 X |
| 1,248,288 | 11/1917 | Doud | 312/329 X |
| 1,400,643 | 12/1921 | Van Dyke | 312/329 X |
| 2,457,248 | 12/1948 | Lemke | 312/329 |
| 3,211,509 | 10/1965 | Sender | 312/329 |

*Primary Examiner*—Kenneth J. Dorner

*Assistant Examiner*—Brian K. Green

*Attorney, Agent, or Firm*—Bucknam and Archer

[57] ABSTRACT

A bin for installation in a cabinet having a hinged door is made of essentially a right angle triangular shape with one rounded side. The bin is constructed by drawing a circle having a center point (3), this point (3) being obtained by drawing a first line 10–10½ inches from the outer edge point (4) of the bin to reach a point (6), said first line being about 1 inch less than the width of the bin, drawing a second line at an angle of 49–49½ degrees to intersect point (6) and extending the second line for a distance 1½–1⅝" outwardly to obtain point (3), drawing a circle using point (3) as the center and 11–11½ inches as the radius. The rounded side of the bin is formed by the arc of the circle. The width of the bin is one inch less than the width of the door and the height of the bin is almost the same as the height of the door.

2 Claims, 3 Drawing Sheets

BIN FOR INSTALLATION IN A CABINET HAVING A HINGED DOOR

The present invention relates to bins of the type which are installed in a cabinet, the cabinet having a hinged door which can swing open. Although the invention covers specifically waste bins being inserted in a kitchen cabinet, it is applicable to other bins being used for instance in factories, not necessarily to collect waste materials but to separate certain products from others.

The waste bins commonly inserted at present in kitchen cabinets are small and of limited use because of their small volume. Also, conventionally, they are much shorter than the height of the door.

The crux of the present invention resides in providing bins of substantially greater volume. The bin according to the present invention has essentially a right angle triangular shape with one curved side. In order to utilize maximum space in the interior of the cabinet, the dimensions have been so selected that the bin is essentially flush with the interior wall of the door and is larger than conventional bins.

According to specific embodiment of the invention, two bins may be inserted in both door panels of a cabinet which is opened in the middle of the two panels which are mirror images one of the other.

According to the invention, the bin may reach almost the top edge of the door so that the volume achieved is substantially greater than with conventional bins.

The invention is illustrated by reference to the drawings of which:

Figure 1:
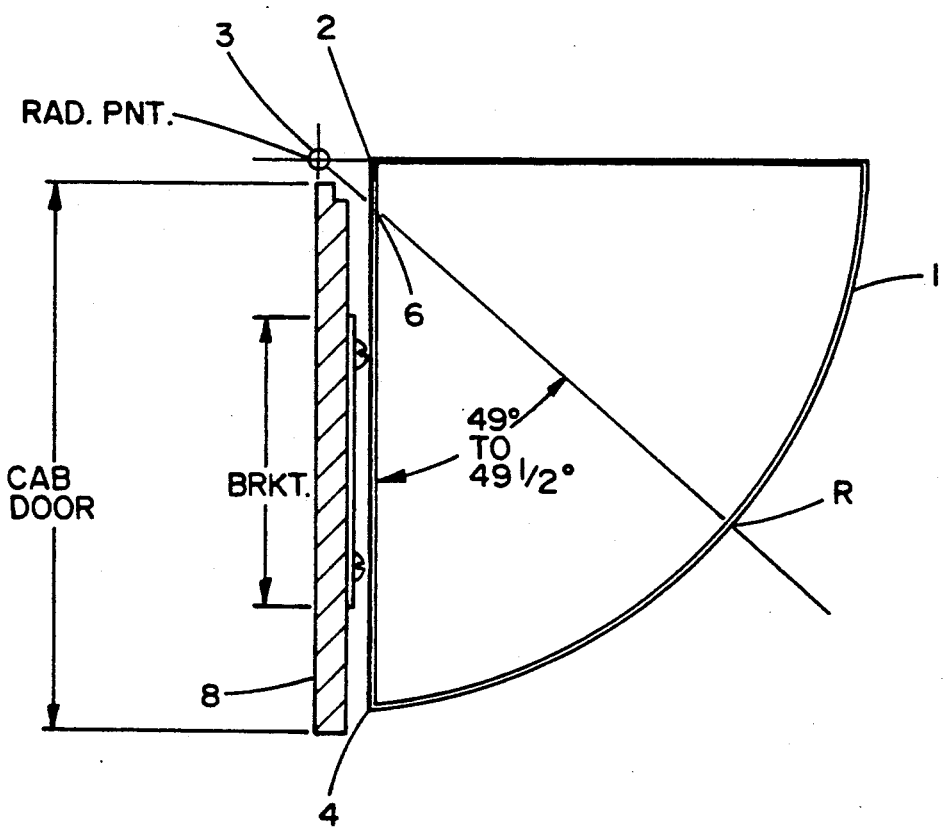
FIG. 1 is a plan view of the bin of this invention.
Figure 2:
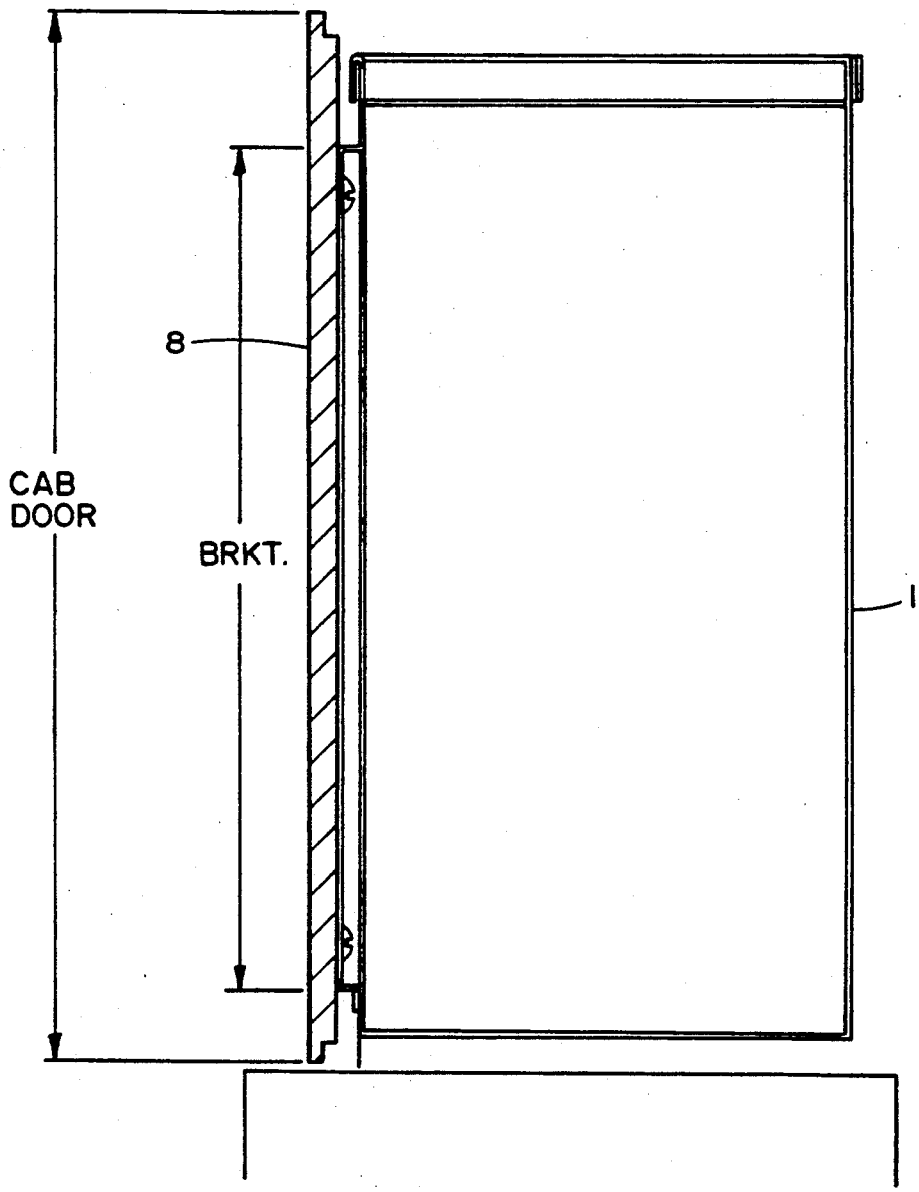
FIG. 2 is an elevational view of the bin.

The crux of the present invention resides in a door having a bin attached thereto, the door having an inner face, a predetermined width and a predetermined height, the height being about 10 inches greater than the width, the bin having essentially a right angle triangular shape having a curved wall, a first straight wall and a second straight wall. The first and second straight walls converge to form a right angle at a first point (2), the bin having an outer edge (4), the first straight wall being the height of the bin secured to the inner face of the door and extending up to the outer edge, the second straight wall being the width of the bin, said width being about one inch less than the width of the door. The curved wall is an arc of a circle having a second point (3) as the center point and a radius R of 11–11½ inches, the second point (3) being located externally to the first point (2) and outside of the periphery of a bin, the radius R intersecting the first straight wall at a third point (6). The third point (6) is one inch from the first point (2) and the radius R being a line which extends from the second point (3) and passes through the third point (6) and forms an angle of 49–49½ degrees with the first straight wall. The second point (3) is at a distance of 1½–1⅝ inches from the third point (6), whereby said bin has a capacity of 7.66 dry gallons with a door 11½ inches wide and 22½ inches high.

By reference to the figures, numeral 1 designates the bin. Numeral 2 designates the center of the circumference which has been conventionally used to obtain the arc of the bin. Numeral 3 designates the point used in the present invention to draw a circle. The point 3 is obtained by drawing a line from point 4 at the outer edge of the bin which is 10–10½ inches, up to point 6, this line being 1 inch less than the width of the bin. From point 6, a line is drawn at an angle of 49°–49½° to reach point R. Point 3 then is obtained by drawing a line 1.5–1⅝" from point 6 towards the exterior. The distance from point 3 to the outer edge of the bin point 4 is 11–11½". Numeral 8 designates the hinged door.

Figure 3:
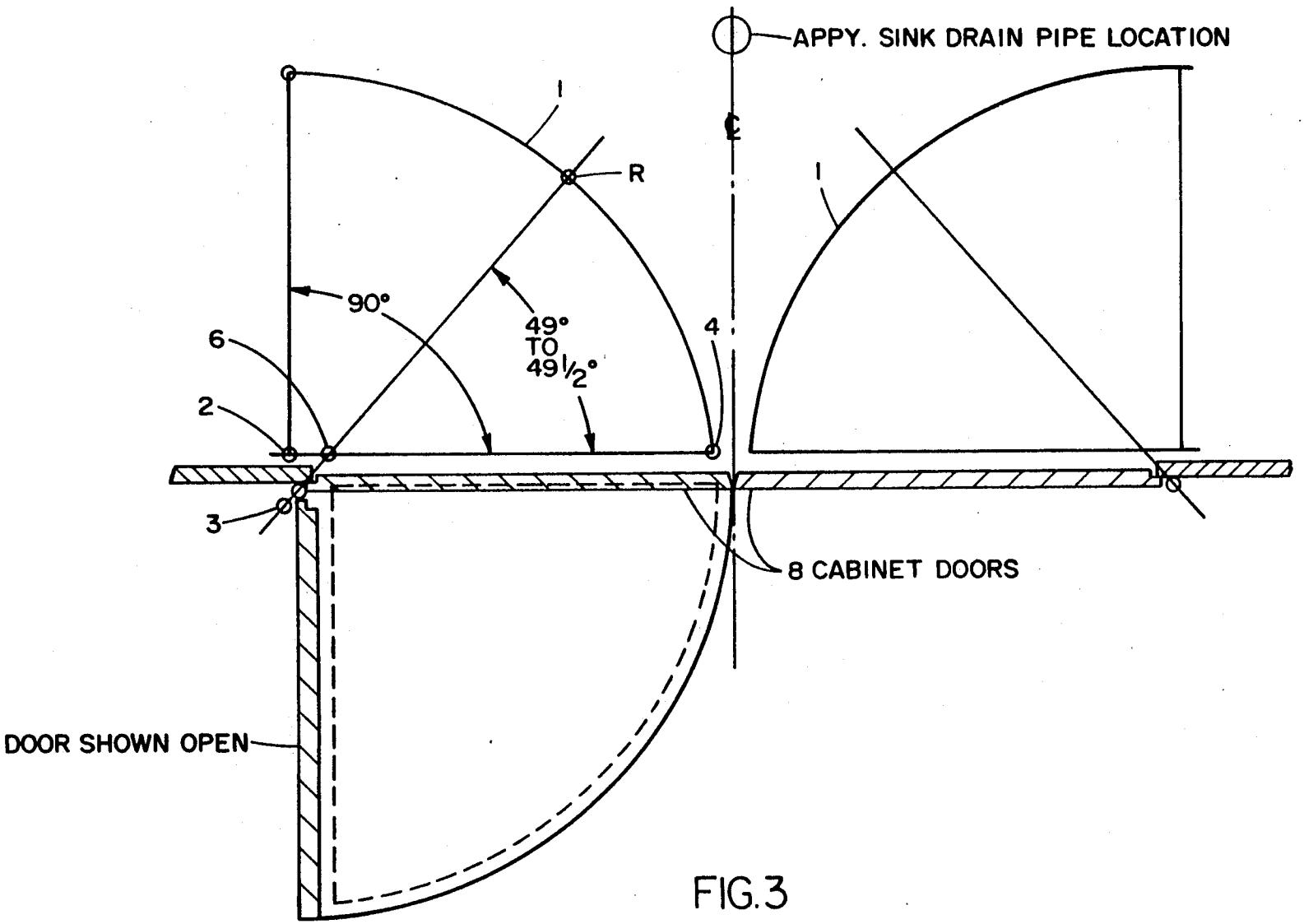
FIG. 3 is a plan view of a pair of hinged doors also showing the left door in open position in dashed lines.

As shown in FIG. 3, the distance between point 4 and the center line where the two door panels meet is about ½". Numeral 4 designates the point at which each line extends. The distance from point 4 to point 3 is 11–11½". The distance from point 4 to point 6 is 10–10½". The line from point 3 to R going through point 6 is at an angle of 49–49½° from the line which connects point 4 to point 2. The distance from point 3 to point 6 is 1.5–1-1/5". Thus by using point 3 as the center of a circle, one obtains the arc which forms the rounded side of the triangle of the bin according to the invention.

The width of the bin is about one inch less than the width of the door and the height is almost the same as the height of the door.

The bin according to the present invention has a capacity of 7.66 dry gallons for a door 11½ inches wide, 22½ inches high and sufficient area inside the cabinet.

Although the invention has been illustrated with reference to a door 22½ inches high and 11½ inches wide, the selection of point 3 may be adjusted according to the size of different doors.

The bin may be applied to the door by means of brackets (not shown).

The advantages of the bin according to the present invention are the following:

1. The capacity of the bin is 7.66 dry gallon capacity for a 11½ wide door.

2. The user needs only to open the cabinet sink door to have the top of the bin in full view, at a desirable height to discard waste and easily remove the contents. If waste material is involved, the possibility of littering the inside of the cabinet is eliminated.

3. A handicapped person would find a decided advantage over other systems.

4. The use of both a right hand and a left hand bin would simplify the task of separating material for recycling as requested by many municipalities.

What is claimed is:

1. A door having a bin attached thereto, said door having an inner face, a predetermined width and a predetermined height, said height being about 10 inches greater than said width, said bin having essentially a right angle triangular shape having a curved wall, a first straight wall and a second straight wall, said first and second straight walls converging to form a right angle at a first point (2), said bin having an outer edge (4), the first straight wall being the height of the bin secured to the inner face of the door and extending up to the outer edge, the second straight wall being the width of the bin, said width being about one inch less than the width of the door, said curved wall being an arc of a circle having a second point (3) as the center point and a radius R of 11–11½ inches, said second point (3) being located externally to said first point (2) and outside of a periphery of said bin, said radius R intersecting the first straight wall at a third point (6), said third point (6) being one inch from said first point (2), said radius R being a line extending from the second point (3) and passing through said third point (6) and forming an angle of 49–49½ degrees with said first straight wall, said second point (3) being at a distance of $1\frac{1}{2}$–$1\frac{5}{8}$ inches from said third point (6), whereby said bin has a capacity of 7.66 dry gallons with a door $11\frac{1}{2}$ inches wide and $22\frac{1}{2}$ inches high.

2. A door according to claim 1 wherein there is a second door, the second door having a bin attached thereto, said second door being a mirror image of said first door.

* * * * *